United States Patent [19]

Traut et al.

[11] Patent Number: 4,689,629

[45] Date of Patent: Aug. 25, 1987

[54] SURFACE WAVE ANTENNA

[75] Inventors: G. Robert Traut, Danielson; Geoff J. Wilson, Rogers, both of Conn.

[73] Assignee: Rogers Corporation, Rogers, Conn.

[21] Appl. No.: 424,834

[22] Filed: Sep. 27, 1982

[51] Int. Cl.[4] ..... H01Q 13/10

[52] U.S. Cl. ..... 343/770; 343/785

[58] Field of Search ..... 343/770, 785, 700 MS, 343/753, 754, 908

[56] References Cited

U.S. PATENT DOCUMENTS

| | | | |
|---|---|---|---|
| 2,405,242 | 8/1946 | Southworth | 343/785 |
| 2,433,924 | 1/1948 | Riblet | 343/785 |
| 2,557,951 | 6/1951 | De Rosa et al. | 343/770 |
| 2,783,467 | 2/1957 | Gutton et al. | 343/785 |
| 2,921,309 | 1/1960 | Elliott | 343/781 P |
| 2,993,205 | 7/1961 | Cooper | 343/785 |
| 3,018,480 | 1/1962 | Thourel | 343/785 |
| 3,283,330 | 11/1966 | Chatelain | 343/700 MS |
| 3,643,262 | 2/1972 | Dumanchin | 343/908 |
| 4,160,976 | 7/1979 | Conroy | 343/700 MS |

FOREIGN PATENT DOCUMENTS

| | | | |
|---|---|---|---|
| 1194342 | 6/1970 | United Kingdom | 343/785 |

OTHER PUBLICATIONS

"Developments in Printed Antenna Design," by McDonough et al. Electronic Design, Jun. 1, 1957 pp. 42–45.

"Leaky Wave Antenna Using an Inverted Strip Dielectric Waveguide" by Crampagne et al. Proceedings 10th Microwave Conf. 8-12-80.

Antenna Engineering Handbook, by H. Jasik 1961 Chapter 16, 40, pp. 10-22-16-28 and FIGS. 16-25(c); 16.37(A).

Microwave Antennas by A. Z. Fradin 1961, pp. 32–35.

Microwave Scanning Antennas vol. II, by R. C. Hansen 1966, pp. 151-157

*Primary Examiner*—Eli Lieberman
*Assistant Examiner*—Karl Ohralik
*Attorney, Agent, or Firm*—Fishman & Dionne

[57] ABSTRACT

A surface wave microwave antenna is presented in which transmission or reception of microwave energy is effected by discontinuities in a dielectric body positioned between a central feeder element and a ground plane. When used as a transmitter, the central disc propagates surface waves in the dielectric body in expanding circles; and the discontinuities in the dielectric body act as radiating or scattering sites to couple the waves to free space. When used as a receiver, the reverse will occur.

23 Claims, 11 Drawing Figures

SURFACE WAVE ANTENNA

BACKGROUND OF THE INVENTION

This invention relates to the field of microwave antennas. More particularly, this invention relates to a surface wave antenna for use as a transmitter or receiver primarily for broadcasted microwave signals for TV systems. While this invention may have general utility in microwave transmission or reception, the invention will be described in the preferred environment of a direct satellite broadcasting (DSB) system. However, it will be understood that the invention may have general utility as either a receiver or transmitter in microwave communication systems.

With the growing potential for satellite transmission of microwave signals for TV broadcasting and receiving systems, there is an increasing need for a reliable, durable and reasonably inexpensive antenna for household and other commercial use for the reception of satellite transmitted microwave signals. Parabolic antennas are traditionally used in transmission systems of this type, but they present many problems for an effective and commercially viable TV microwave reception system. Among other problems, parabolic antennas are relatively expensive, and are not sufficiently stable in low winds to guarantee consistent signal reception and hence picture quality. Thus, they are not particularly suitable for everyday use in home or other commercial TV reception systems.

Stripline or microstrip antennas for microwave transmission or reception are known in the art. Such antennas are shown, for example, in UK Pat. No. 1,529,361 to James and Wilson, U.S. Pat. Nos. 3,995,277 to M. Olyphant, Jr., 3,987,455 to M. Olyphant, Jr. and 3,803,623 to L. Scharlot, Jr. In all of these prior patents the antenna structure consists of a laminate structure of a dielectric material with an electrically conductive ground plane on one surface of the dielectric and a stripline or microstrip pattern on the other surface of the dielectric. It is well known that the properties of the dielectric material are important to the performance of the antenna, especially the properties of dielectric constant and dissipation factor. Those considerations make these conventional microstrip antennas practicably unsuitable for TV receiver only (TVRO) antennas because they severely limit the choice of suitable dielectric materials to very expensive materials, especially when one considers that a TVRO antenna must be relatively large, such as on the order of a square structure 30 to 40 inches on each side or a circular structure having a diameter of 30 to 40 inches. Also, since TVRO antennas will be used outdoors, they must be weatherized to protect them from exposure to the elements. This is particularly so with the conventional prior art stripline or microstrip antennas where the circuit pattern and the ground plane are on the exterior of the dielectric surfaces. This weatherizing requirement further adds to the economic and practical problems of using prior art microstrip antennas in TVRO systems.

The combined requirements of electrical properties and weathering resistance limit the choice of dielectric materials that may be effectively employed in a practicable TVRO antenna if one were constructed in accordance with conventional prior art techniques. The combined requirements of electrical properties and weathering resistance limits the choice of dielectric materials. Low loss ceramics would offer good performance for the dielectric material, but the cost and limited size of ceramic substrates would rule them out. PTFE (polytetrafluoroethylene) based substrates or substrates based on other fluoropolymers would also be acceptable choices from the standpoint of dielectric properties, but the cost of such substrates would make them unsuitable for home and general commercial use. Thus, because of the economic and other practical drawbacks, the art has not developed a commercially practicable and acceptable planar TVRO antenna.

The microstrip antennas disclosed in the previsously mentioned UK Pat. No. 1,529,361 and U.S. Pat. Nos. 3,995,277, 3,987,455 and 3,803,623 may be described, in general terms, as having a dielectric body with a ground plane on one surface and a radiator pattern on the other surface. It is known that antennas of this type can experience a problem of surface waves which are generated at the boundaries of the dielectric support for the radiator and air. These surface waves will travel between radiators and constitute a power loss in the system and impair the quality of beam formation.

SUMMARY OF THE INVENTION

The above-discussed and other problems of the prior art are overcome or reduced by the antenna of the present invention. It is expected that the antenna of the present invention will find practical application primarily as a receiving antenna in a direct satellite broadcasting system. However, because of the reciprocal nature of microwave antennas, the antenna of the present invention may be used either as a transmitter antenna or as a receiver antenna. Furthermore, because explanation of the operation of the antenna of the present invention is more convenient when discussing operation in the transmission mode, the antenna will be discussed from the standpoint of the transmission mode; but it will, however, be understood that the antenna is expected primarily to be used as a receiver, with the receiver mode being a reciprocal of the transmission mode.

In accordance with the present invention, the microwave antenna is composed of a dielectric body in the form of a disc with a conductor ground plane on one side of the disc and a conductive center element on the other side of the dielectric body. Discontinuities are incorporated in the dielectric body. The center element and the metal plate are each coupled to the leads from a coaxial cable carrying a microwave signal. The microwave signal is converted to a surface wave propagating outwardly as an expanding circle from the launch disc toward the outer edge of the dielectric.

The dielectric material is intentionally provided with a predetermined pattern of discontinuities which define and perform as microwave radiators. These discontinuities may be in the form of slots or openings in the body of dielectric material or they may be in the form of grooves, slots, ridges or other discontinuities either projecting from or extending into the dielectric material; or the discontinuity could be a surface or volume of material of a different dielectric constant incorporated in the dielectric body. When the expanding circular waves in the dielectric body encounter the discontinuities, they are coupled to free space by radiating or scattering in predetermined beam form at the discontinuities. The signals are thus radiated in the free space where they may be received by a similar reciprocal antenna located at a receiver station.

The surface wave antenna of the present invention does not rely on metal radiators connected to a powered feed line for signal generation or reception, as is the case with microstrip antennas. Rather, the antenna of the present invention deliberately sets up and takes advantage of surface waves (which in other antenna systems are a serious problem). The surface waves are radiated and transmitted into free space by discontinuities in the dielectric disc in which the surface waves are established. Thus, the present invention creates a particularly effective microwave antenna by taking advantage of and putting to use what has previously been regarded as a problem in other microwave antennas.

BRIEF DESCRIPTION OF THE DRAWINGS

Referring now to the drawings, wherein like elements are numbered alike in the several figures.

DESCRIPTION OF THE PREFERRED EMBODIMENTS

Figure 1:
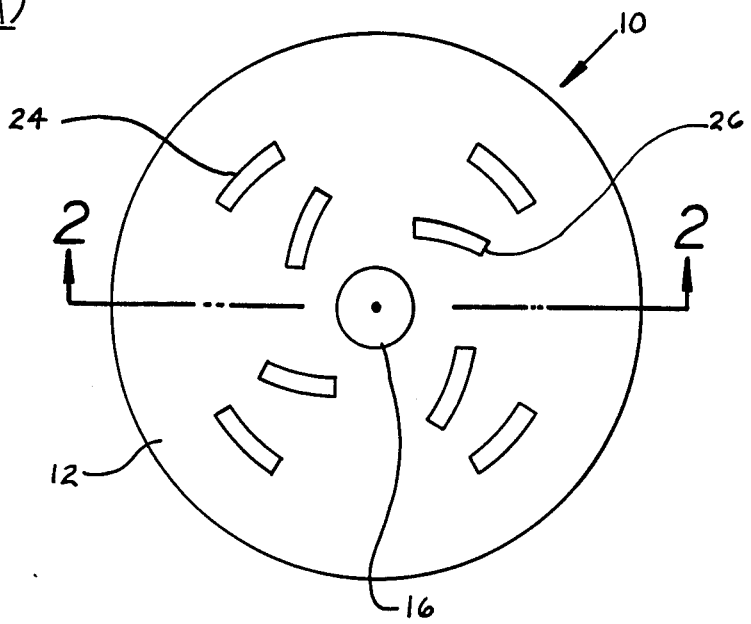
FIG. 1(A) is a top plan view of a microwave surface antenna in accordance with the present invention.
FIG. 1(B) is a view similar to FIG. 1(A) showing a modified version of the antenna.
Figure 1:
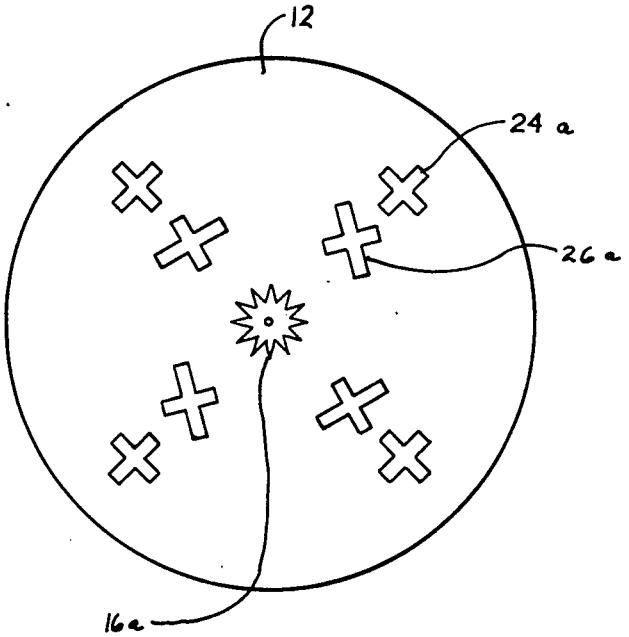
Figure 2:
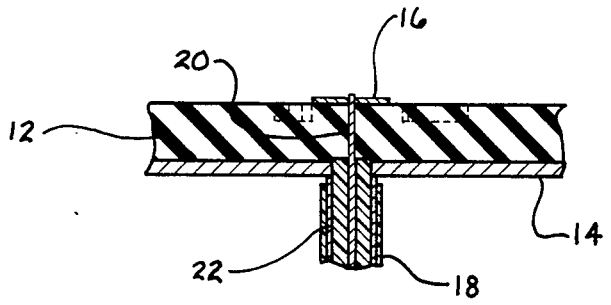
FIG. 2 is a partial sectional elevational view taken along line 2—2 of FIG. 1.

Referring first to FIGS. 1 and 2, the surface wave antenna 10 of the present invention has a dielectric body 12, preferrably in the form of a rectangular or disc shaped plate. The antenna has a metal layer 14 on the bottom surface of dielectric body 12 and metal disc 16 (sometimes referred to as a launch element) on the top surface of dielectric body 12. Both metal layer 14 and launch disc 16 are conductive metal elements, and they may be metal plates or metallized surfaces formed on the respective surfaces of dielectric body 12. A coaxial cable 18 has the inner conductor or center pin 20 electrically connected to launch disc 16, and the outer conductor 22 of the coaxial cable is electrically connected to metal plate 14. The coaxial cable carries a microwave signal which is transformed or converted from coaxial to surface wave form and propagates surface waves in the form of expanding circles in dielectric body 12 by the interaction of launch disc 16 and metal layer 14. These surface waves propagate as expanding circles from the coaxial connection toward the outer periphery of dielectric body 12.

Dielectric body 12 is provided with an array of discontinuities which serve to couple the expanding circular waves to free space by radiating the waves in a high gain beam. In the configuration shown in FIG. 1(A), the discontinuities are in the form of a predetermined pattern of grooves or slots formed starting in the upper surface of dielectric body 12 and penetrating at least part way into the dielectric body. In FIG. 1(A) these grooves or slots are illustrated in the form of arc shaped grooves or slots 24 and 26. Grooves 24 are radially or symmetrically aligned and grooves 26 being nonradial or nonsymmetric. It will, however, be understood that these shapes are shown only for purposes of illustration; other shapes may be used, and other arrays or arrangements of the location of the grooves or slots will be employed, depending on the requirements of a given situation. A configuration of "X" or "t" grooves or slots is shown at 24*a* and 26*a* of FIG. 1(B). Slots 24(*a*) are radially aligned and symmetric; slots 26(*a*) are nonradial and nonsymmetric.

As indicated above, a microwave signal in a coaxial line is converted to a surface wave radiating in all directions along the dielectric disc 12 from the coaxial connection. While the lower metal plate 14 may be omitted in some configurations (and replaced by a cooperating launch disc essentially similar to launch disc 16 to effect transition from coaxial to surface wave), the radiating surface wave will be more confined to the dielectric layer 12 and more controllably coupled to free space with the metal sheet 14 present in the configuration. Confinement of the surface wave to the dielectric layer and controllable coupling to free space are also enhanced if the dielectric constant of the dielectric material is high, such as on the order of from 5 to 10. The diameter of disc 16 is selected such that reflections in the coaxial to surface wave transition are minimal for the desired center frequency. Other transition schemes may also be employed. For example, disc 16, rather than being circular as in FIG. 1(A) may be replaced with an element 16*a*, as shown in FIG. 1(B) where the edges are cut to a series of points in a star fashion to effect a smooth transition from parallel plate to surface wave.

Figure 3:
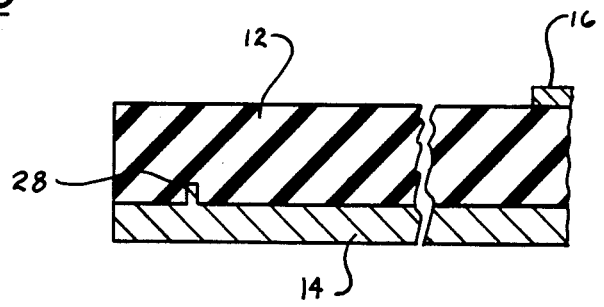
FIGS. 3–8 are partial sectional elevational views, similar to FIG. 2, showing various alternate configurations for creating discontinuities in the dielectric disc of the antenna of the present invention.
Figure 4:
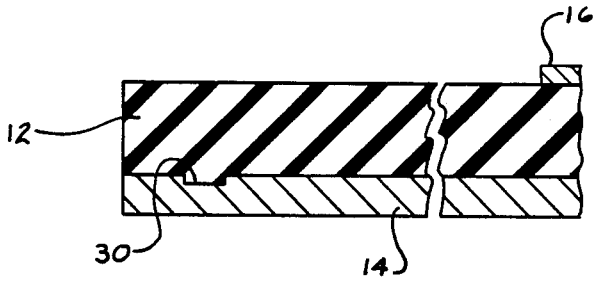
Figure 5:
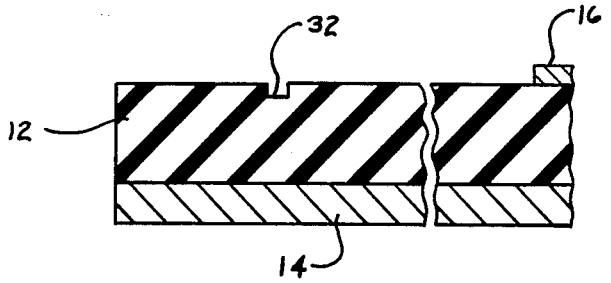
Figure 6:
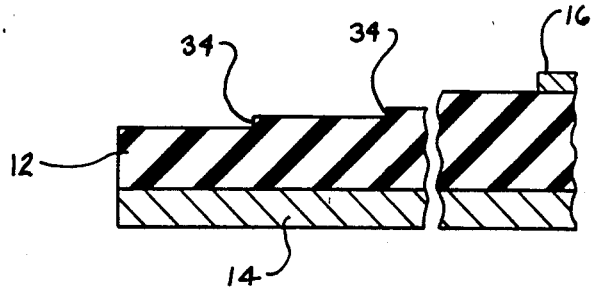
Figure 7:
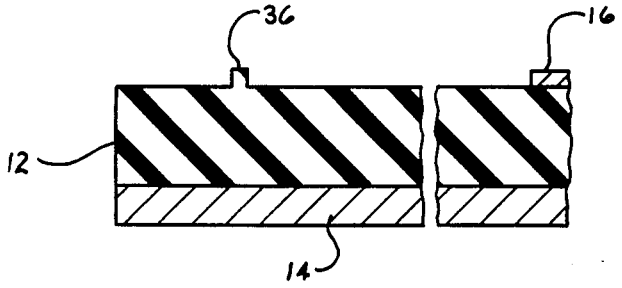
Figure 8:
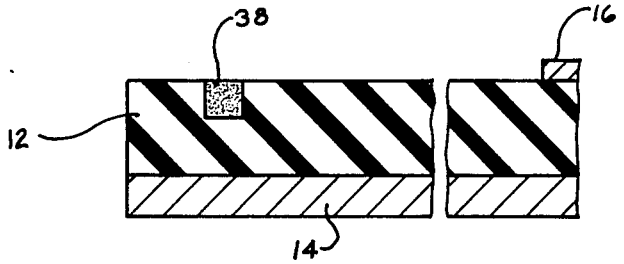

Many different kinds of discontinuities can be employed to provide radiation or scattering and free space coupling of the circular wave in the dielectric disc. By way of example, but not by way of limitation, the discontinuities could be in the form of straight, curved or bent grooves or ridges of various widths, depths or length in the dielectric disc. The discontinuities may be either in the dielectric/air surface (i.e., between the upper surface of the dielectric disc and the air to which it is exposed, or in the metal/dielectric surface between metal plate 14 and disc 12). Several such types of discontinuities are illustrated in FIGS. 3 through 8. FIG. 3 illustrates a discontinuity resulting from a raised ridge 28 in metal plate 14 which projects into dielectric disc 12. FIG. 4 illustrates another type of discontinuity in which a section of dielectric 12 projects into a notch or recess 30 in plate 14. FIG. 5 illustrates a type of discontinuity essentially similar to FIGS. 1 or 2 in the form of a notch or recess 32 in the upper surface of disc 12. FIG. 6 illustrates still another type of possible discontinuity in the form of a series of steps 34 in the upper surface of disc 12. FIG. 7 illustrates a type of discontinuity consisting of a ridge or projection 36 extending above the upper surface of dielectric disc 12. FIG. 8 shows a type of discontinuity formed by a dissimilar material 38 embedded in the upper surface of dielectric disc 12. Embedded material 38 could, for example, be either a dielectric material of different dielectric constant than disc 12, or it could be an inserted metal or other material. It will be understood that the various discontinuities shown in FIGS. 3 through 8 are intended only to be illustrative of various kinds of discontinuities that may be employed, either in the metal 14/dielectric 12 interface or in the dielectric 12/air interface. Also, it will be understood that no attempt has been made to illustrate any particular arrangement or array of discontinuities.

As a surface wave passes any discontinuity, a fraction of the wave energy in the surface wave is radiated or scattered. The orientation of a discontinuity will control the polarity of the radiated wave. Depth and width of a discontinuity will determine the fraction of energy radiated, and the radial distance of the discontinuity from the center of disc 12 will determine the phase of the radiated wave. Thus, with an understanding of these factors which determine the characteristics of a radiated wave, an array of oriented slots can be arranged at a series of radial distances from the center of disc 12 by surface wave length increments to provide a polarized wave front in space that has a narrow beam. The distribution of radiation intensity over the beam aperture is controlled by spacing, depth and width of the discontinuities. Ideally, the radiation or scattering fractions would be designed so that very little surface wave energy remains in the dielectric disc 12 by the time the outer edge of the disc is reached.

As frequency is varied from the designed center frequency, the phase relationship of slots at various radii in a sector will change causing a squint deflection of the beam in that sector towards or from the center. The combined effect of all sectors will be to broaden the beam and lower gain. Band width is enhanced and beam width broadening minimized at lower surface wave velocities. Thus, there must be a compromise between permittivity of the dielectric between band width and the containment of the surface wave in the dielectric disc.

If circular polarization is desired, it may be achieved by one or more additional arrays of discontinuities oriented for different polarity and spaced from the center for different phases.

Figure 9:
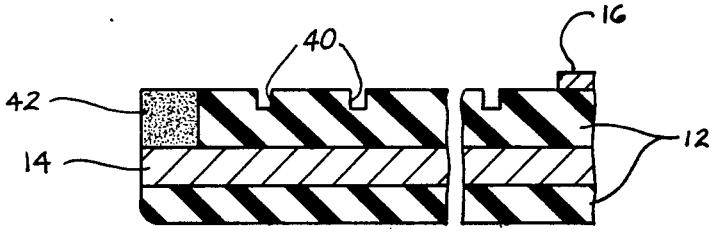
FIG. 9 shows another, and possibly preferred, construction.

FIG. 9 shows what is believed to be a particularly attractive configuration for the antenna of the present invention. In the FIG. 9 arrangement, dielectric 12 is a low loss thermoplastic material, such as Teflon FEP—a fluorocarbon copolymer, filled with titania with slots 40 formed in the disc 12. Metal layer 14 is an aluminum plate. A premolded edge material 42 is mounted on the upper surface of plate 14 at the outer periphery therof and forms an outer peripheral ring around dielectric disc 12. Ring 42 is a composite of a dielectric material, such as PTFE or epoxy resin, filled with carbon, low conductive metals such as lead, or other lossy filler material. Edge ring 42 is a lossy component, and it serves to absorb or dissipate any surface wave energy which reaches the edge of disc 12, thereby preventing reflection and interference. As can be seen in the FIG. 9 configuration, it is also desirable to form the carrier dielectric 12 on both sides of metal plate 14 to balance thermal stresses and avoid distortion of the antenna during service.

The antenna of the present invention may be formed in a molding process. Metal plate 14, which may be aluminum, may be a pre-formed metal disc which is used as a molding insert. Plate 14 may be inserted directly into the base of the mold (if the dielectric material is to be only on the top surface of plate 14) or plate 14 may be inserted in the mold after the mold has been partially filled with the uncured molding material from which disc 12 is to be formed. The molding material for disc 12 (or the portion thereof above plate 14) is then inserted into the mold. If the lossy outer ring 42 in FIG. 9 is to be employed, it is also inserted into the mold as a pre-formed insert on top of the metal plate 14 prior to loading of the dielectric molding material into the mold on top of plate 14. The mold is then be covered with a top plate having projections to form the discontinuities in disc 12 (or the discontinuities may result from projections or recesses in plate 14). Heat and pressure is then be applied to cure the dielectric molding material to form disc 12 and bond it to ground plate 14. Launch disc 16 may be added prior to the molding stage or after as may be desired.

Figure 10:
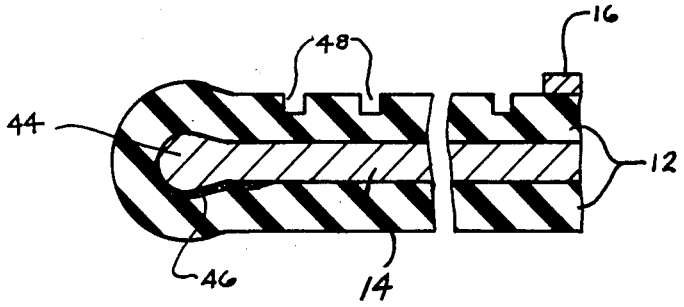
FIG. 10 shows still another, and possibly preferred, construction.

Referring now to FIG. 10, another desirable configuration is shown. In the configuration of FIG. 10, metal plate 14 has a large radius bulbous outer edge 44. A lossy coated 46 is on the underside of the outer portion of plate 14 extending to and tapering the bottom end of bulb 44. Lossy coating 46 may, for example, be a metal oxide, an iron alloy or lead. The dielectric disc 12 (with discontinuities 48) is formed around the bulb 46 and is on both sides of plate 14. With this construction, any surface waves which reach the outer edge of disc 12 will be terminated into the lossy coating 46 on the underside of plate 14 to eliminate reflections.

The configuration of FIG. 10 may also be made in a molding process. Molding material for the lower portion of disc 12 is loaded into the mold; plate 14 with bulbous edge 44 is then inserted into the mold and centered relative to the molding material so that a portion of the molding material below plate 14 extends beyond bulbous edge 44. The remainder of the molding material for disc 12 is then added to the mold, and the molding process with heat and pressure is completed as previously described.

Plastic materials for the dielectric of the antenna will have to combine low loss (preferrably a loss tangent of 0.01 or less) with resistance to ultraviolet radiation and weather and have dimensional stability in a temperature range of about −20° C. to 120° C. These requirements must be met for proper antenna performance and to resist weather exposure for the antenna to be suitable for use, for example, as a receiver for satellite signals for receiving home television programming. Possible candidates for the dielectric material include melt processible fluoropolymers such as Teflon PFA, Teflon FEP or Tefzel ETFE. The dielectric may also be a low loss glass or ceramic, either metallized or fired onto a metal base for plate 14. This approach may require grinding to form discontinuities such as slots in the dielectric, but it could offer particularly attractive thermal stability characteristics.

While the antenna of the present invention has, for purposes of convenience, been described in terms of transmitter operation, it will be understood, as indicated above, that it will operate as a receiver antenna in reciprocal fashion with the discontinuities acting as receiver radiator sites. Indeed, the principal use envisioned for the antenna of the present invention is as a receiver for satellite transmitted microwave signals in a home TV system. Such an antenna constructed in accordance with the present invention will be particularly effective, practical and economical. The antenna is dimensionally stable, and, hence, it may be mounted on the exterior of buildings (such as roof houses or other similar structures), and it may be mounted in rotatable structure for directional alignment without impairing reception of the transmitted signal, and hence the consistancy of the picture displayed on the TV screen to which the antenna is connected.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A surface wave antenna for microwave communications, the antenna including:

means defining a conductive ground plane;

a dielectric body on said ground plane, said dielectric body having opposed surfaces;

a plurality of discontinuities extending only partially into said dielectric body from one of said opposed surfaces, said discontinuities being arranged in a predetermined array; and a centrally positioned conductive element on said dielectric body and spaced from said ground plane.

2. A surface wave antenna as in claim 1 wherein:

said discontinuities constitute antenna radiator sites.

3. A surface wave antenna as in claim 1 wherein:

said discontinuities are provided in the upper surface of said dielectric body.

4. A surface wave antenna as in claim 3 wherein:

said discontinuities are recesses in the upper surface of said dielectric body.

5. A surface wave antenna as in claim 3 wherein:

said discontinuities are portions of different heights.

6. A surface wave antenna as in claim 1 wherein:

said discontinuities are associated with the surface of said dielectric body on the ground plane.

7. A surface wave antenna as in claim 6 wherein:

said discontinuities are portions of different height extending from said dielectric body toward said ground plane.

8. A surface wave antenna as in claim 6 wherein:

said discontinuites are recesses in said dielectric body formed by projections from said ground plane.

9. A surface wave antenna as in claim 1 wherein:

said dielectric material has a dielectric constant of from about 5 to about 10.

10. A surface wave antenna as in claim 1 wherein:

said dielectric body is a low loss material characterized by resistance to ultraviolet radiation and weather, and having dimensional stability in a temperature range from about −20° C. to about 120° C.

11. A surface wave antenna for microwave communication, the antenna including:

a dielectric body;

a conductive ground plane at least partly contained within said dielectric body;

a plurality of discontinuities extending only partially into said dielectric body, said discontinuities being arranged in a predetermined array;

a centrally positioned conductive element positioned on said dielectric body and spaced from said ground plane; and lossy means associated with the outer periphery of said ground plane.

12. A surface wave antenna as in claim 11 wherein:

said lossy means includes a ring of lossy material positioned on said ground plane.

13. A surface wave antenna as in claim 11 wherein:

said lossy means includes an enlarged peripheral portion on said ground plane, and a lossy material on said ground plane.

14. A surface wave antenna as in claim 13 wherein:

said lossy material is on the outer periphery of said ground plane on the side removed from said centrally positioned conductive element.

15. A surface wave antenna for microwave communications, the antenna including:

a dielectric body;

a plurality of discontinuities extending only partially into said dielectric body, said discontinuities being arranged in a predetermined array;

a centrally positioned conductive element on one surface of said dielectric body; and conductive means on the other surface of said dielectric body to effect transition from feed line to surface wave.

16. A surface wave antenna as in claim 15 wherein:

said discontinuities constitute antenna radiator sites.

17. A surface wave antenna as in claim 15 wherein:

said discontinuities are provided in the upper surface of said dielectric body.

18. A surface wave antenna as in claim 17 wherein:

said discontinuities are recesses in the upper surface of said dielectric body.

19. A surface wave antenna as in claim 17 wherein:

said discontinuities are portions of different heights.

20. A surface wave antenna as in claim 15 wherein:

said discontinuities are associated with the surface of said dielectric body adjacent to said conductive means.

21. A surface wave antenna as in claim 15 wherein:

said discontinuities are portions of different height extending from said dielectric body toward said conductive means.

22. A surface wave antenna as in claim 15 wherein:

said dielectric material has a dielectric constant of from about 5 to about 10.

23. A surface wave antenna as in claim 15 wherein:

said dielectric body is a low loss material characterized by resistance to ultraviolet radiation and weather, and having dimensional stability in a temperature range from about −20° C. to about 120° C.

* * * * *